US012385184B2

(12) United States Patent
Lambert et al.

(10) Patent No.: US 12,385,184 B2
(45) Date of Patent: Aug. 12, 2025

(54) METHOD AND SYSTEM FOR CONTINUOUSLY TREATING BIOMASS MATERIAL

(71) Applicant: VALMET AB, Sundsvall (SE)

(72) Inventors: Francois Lambert, Sundsvall (SE); Patrik Pettersson, Alnö (SE); Peter Björklund, Umeå (SE)

(73) Assignee: VALMET AB, Sundsvall (SE)

( * ) Notice: Subject to any disclaimer, the term of this patent is extended or adjusted under 35 U.S.C. 154(b) by 91 days.

(21) Appl. No.: 18/558,642

(22) PCT Filed: May 3, 2022

(86) PCT No.: PCT/SE2022/050425

§ 371 (c)(1),
(2) Date: Nov. 2, 2023

(87) PCT Pub. No.: WO2023/282815

PCT Pub. Date: Jan. 12, 2023

(65) Prior Publication Data

US 2024/0229353 A1 Jul. 11, 2024

(30) Foreign Application Priority Data

Jul. 5, 2021 (SE) ..... 2150878-3

(51) Int. Cl.
*D21C 1/02* (2006.01)
*D21B 1/36* (2006.01)
(Continued)

(52) U.S. Cl.
CPC ..... *D21C 7/08* (2013.01); *D21B 1/36* (2013.01); *D21C 1/02* (2013.01); *D21C 7/12* (2013.01)

(58) Field of Classification Search
CPC ... D21C 1/02; D21C 7/08; D21C 7/12; D21C 1/04; D21C 3/04; C12P 2201/00; D21B 1/36
See application file for complete search history.

(56) References Cited

U.S. PATENT DOCUMENTS 2,861,884 A * 11/1958 Bennett ..... D21C 7/12 236/92 R
3,817,824 A * 6/1974 Marks ..... D21C 7/12 162/239
(Continued)

FOREIGN PATENT DOCUMENTS

CA 2799992 A1 * 12/2011 ..... C12M 21/04
EP 3 663 460 A1 6/2020
(Continued)

OTHER PUBLICATIONS

International Search Report and Written Opinion of the International Searching Authority issued in the corresponding International Patent Application No. PCT/SE2022/050425, dated Jul. 21, 2022.

*Primary Examiner* — Anthony Calandra
(74) *Attorney, Agent, or Firm* — Foley & Lardner LLP

(57) ABSTRACT

A method for continuously treating biomass material includes: feeding the biomass material into a substantially vertically arranged pressurized vessel; adding steam to said pressurized vessel for hydrothermal treatment of the biomass material, wherein said adding steam comprises adding steam at a lower portion of the pressurized vessel; discharging the biomass material from a bottom portion of the pressurized vessel using a discharge device; withdrawing vapor from a top portion of the pressurized vessel, and adding said vapor to the discharge device; controlling differential pressure between said top portion of the pressurized vessel and said discharge device by controlling a flow of said vapor; and determining a minimum flow of steam needed to
(Continued)

heat the biomass material in the pressurized vessel to a predetermined temperature, wherein said adding steam comprises adding steam at a flow that is higher than said minimum flow.

15 Claims, 2 Drawing Sheets

(51) Int. Cl.
*D21C 7/08* (2006.01)
*D21C 7/12* (2006.01)

(56) References Cited

U.S. PATENT DOCUMENTS

| | | | | | |
|---|---|---|---|---|---|
| 5,674,360 | A * | 10/1997 | Wyllie | D21C 7/06 | 162/52 |
| 2015/0233053 | A1* | 8/2015 | Stromberg | D21C 7/08 | 162/247 |
| 2021/0254281 | A1* | 8/2021 | Melander | C08H 8/00 | |
| 2023/0098986 | A1* | 3/2023 | Sjöblom | D21C 7/00 | 162/63 |
| 2023/0220620 | A1* | 7/2023 | Lambert | D21B 1/36 | 162/21 |

FOREIGN PATENT DOCUMENTS

| | | | | |
|---|---|---|---|---|
| SE | 543000 | C2 | 9/2020 | |
| SE | 2330081 | A1 * | 8/2024 | D21C 7/12 |
| WO | WO-9610674 | A1 * | 4/1996 | D21B 1/021 |
| WO | WO-2014/047097 | A1 | 3/2014 | |

* cited by examiner

METHOD AND SYSTEM FOR CONTINUOUSLY TREATING BIOMASS MATERIAL

TECHNICAL FIELD

The invention relates to the field of continuous treatment of biomass material, more specifically hydrothermal treatment of biomass material in a substantially vertically arranged pressurized vessel.

BACKGROUND

Systems for hydrothermal treatment of biomass material such as lignocellulose containing biomass material are well known in the art.

The hydrothermal treatment is performed at elevated pressure and temperature by adding the biomass to a pressurized reactor vessel into which steam is added for heating the biomass to saturation temperature by direct condensation. The pressure level of the reactor which may be designed for continuous operation is in the range 5-30 bar and the retention time is in the range 1-20 minutes.

During hydrolysis as well as other chemical process of lignocellulosic biomass, VOC and NCG are formed due to the decomposition of the material to for example furfural or acetic acid. They can also be introduced with the material in the feeding system. When heating of the material is done with addition of steam, presence of gas decreases the steam partial pressure and higher steam pressure is needed to reach a given temperature compared to saturation temperature for this pressure. It can even be a problem to introduce steam if the other gases accumulate. VOC and NCG need to be removed from the reactor to be able to heat the reactor in and efficient way.

The reactor may be horizontally or vertically arranged. The hydrothermally treated biomass may be discharged (blown) from the reactor through a blow valve, so called steam explosion discharge.

In a horizontal steam explosion reactor, the steam is used as propeller steam for the material to discharge it through the outlet of the reactor. VOC and NCG are following the steam and evacuated with the material. Optionally, it is possible to vent out the NCG and VOC if necessary, to avoid accumulation for example in the feeding area.

In a vertical reactor, the biomass material forms a compact column which is discharged at the bottom. Steam may be added at the bottom of the reactor to heat the material by going through it upwards, at the top of the reactor or in a steam mixer located before the inlet, at an intermediate position or at a combination of one or more of these. Unlike a horizontal reactor, it is however not possible for the steam (and VOC/NCG) to follow the material and be evacuated therewith. Instead, evacuation of the VOC/NCG is done by venting the gases at the top or the reactor. Some steam will also accumulate at the top of the reactor, in particular if steam is added at the top of the reactor to heat the biomass.

Thus, not only VOC/NCG, but also steam will be vented out, leading to a higher than ideal steam consumption.

SE543000C2 discloses a system for hydrothermal treatment of lignocellulose materials in horizontal and vertical pressurized vessels. A pressure sealing screw continuously discharges the treated material from the vessel to a discharge chamber. Steam is added to the discharge chamber via a control valve for pressure control. The material is discharged from the discharge chamber using a discharge nozzle. Degassing of the pressurized vessel is connected to the discharge chamber.

The system in SE543000C2 is advantageous both in terms of pressure control for steam explosion discharge, and in terms of handling VOC/NCG, in particular in horizontal reactor systems where some of the VOC/NCG follows the biomass material, and thus only some VOC/NCG needs to be vented off. There is however a need for a system with further improved performance, in particular in vertical reactor systems where more VOC/NCG need to be vented off.

SUMMARY

An object of the invention is to provide a further improved method and system for hydrothermal treatment of biomass.

These and other objects are achieved by the present invention by means of a method and a system according to the independent claims.

According to a first aspect of the invention, a method for continuously treating biomass material is provided. The method comprises feeding the biomass material into a substantially vertically arranged pressurized vessel, adding steam to said pressurized vessel for hydrothermal treatment of the biomass material, discharging the biomass material from a bottom or lower portion of the pressurized vessel by means of a discharge device, withdrawing vapor from a top or upper portion of the pressurized vessel, and adding said vapor to the discharge device, and controlling differential pressure between said top or upper portion of the pressurized vessel and said discharge device by controlling the flow of said vapor.

In other words, a method for hydrothermal treatment of biomass material is provided, which method comprises continuously feeding biomass material into a top or upper portion of a vertical pressurized vessel/reactor (preferably via a pressure sealing/isolation device), continuously adding steam (which may be superheated steam) into the pressurized vessel, continuously discharging the (hydrothermally treated) biomass from a bottom or lower portion of the vessel by means of a discharge device. The method further comprises controlling a flow of vapor withdrawn from the top or upper portion of the vessel to the discharge device to control the differential pressure. For instance, if the differential pressure is larger than its target value, the vapor flow is increased and vice versa. The vapor flow may be controlled for example by means of an electrically controllable valve arranged in a conduit between the top or upper portion of the vessel and the discharge device.

It is understood that the vessel being substantially vertically arranged refers to that a longitudinal/lengthwise direction of the vessel is substantially vertical, for example within +−10 degrees relative the vertical direction. It is understood that the bottom and top portions of the vessel refer to a lowermost and uppermost portion of the vessel, respectively, as seen in the vertical direction. It is furthermore understood that the lower and upper portions of the vessel refer to portions of the vessel which is arranged at a vertical distance from each other, with the upper portion being arranged vertically above the lower portion. It is furthermore understood that the discharge device may be partly disposed in the bottom or lower portion. As will be exemplified below, the discharge device may be formed by two or more parts, where at least one of the parts are arranged in said bottom or lower portion of the vessel. It is furthermore understood that the differential pressure is measured between a space in the top portion of the vessel, the space being above the biomass bed in the vessel, and a vapor space in the discharge device. It is important to note that the vapor is added to the discharge device, not to a bottom or lower portion of the pressurized vessel itself.

The invention is based on the insight that the pressure in the discharge device is advantageously controlled by controlling a flow of vapor (comprising VOC/NCG and/or excess steam) from the top of the reactor vessel to the discharge device. This is particularly advantageous in a vertical reactor systems, where the amount of vapor to be vented off is higher than in a horizontal reactor. Thus, rather than controlling the pressure in the discharge device (solely) by adding steam thereto, the pressure is controlled by controlling the flow of vapor added to the discharge device.

In embodiments, the method further comprises adding discharge steam from a source of steam to the discharge device, wherein the differential pressure is furthermore controlled by controlling the flow of said discharge steam. The term discharge steam refers to steam intended for discharge of the material, which discharge steam comes from a source of steam not being the top or upper portion of the pressurized vessel. The discharge steam may be fresh steam.

In embodiments, the discharge device comprises a pressure sealing screw arranged at said bottom portion of the pressurized vessel and a steam explosion device, wherein said vapor and optional discharge steam is added to the steam explosion device.

The steam explosion device may comprise a discharge chamber connected to the pressure sealing screw to receive discharged biomass, and a blow valve arranged for steam explosion discharge of the biomass from said discharge chamber, wherein said vapor is added to said discharge chamber.

The steam explosion device may comprise a transport screw arranged to convey the biomass towards the blow valve. The transport screw may be arranged in the discharge chamber or in a chamber connected to the discharge chamber.

In embodiments, the step of adding steam comprises adding steam at or near the top or upper portion of the pressurized vessel. Alternatively, or additionally, the step of adding steam may comprise adding steam together with the biomass material by means of a mixing device arranged upstream of the pressurized vessel. Alternatively, or additionally, the step of adding steam may comprise adding steam at a lower or bottom portion of the pressurized vessel.

In embodiments, the step of adding steam comprises adding at least 50%, or at least 60%, or at least 70%, or at least 80% of overall added steam at the lower portion. For example, the step of adding steam may comprise adding steam at a lower portion and at one or more additional positions, such as at or near the top or upper portion, and/or in a mixing device arranged upstream of the pressurized vessel, and/or to the discharge device, where the flow of added steam to the lower portion constitutes at least 50/60/70/80% of the overall flow of steam added at the lower portion and at the one or more additional positions. In embodiments, the step of adding steam (to the vessel) comprises adding steam solely at the lower portion, but optionally adding discharge steam to the discharge device as well. The inventors have realized that adding a significant portion (or all) of the steam at the lower portion of the vessel results in that acetic acid formed in the hydrolysis reaction is following the steam up and is condensing on the chips fed in the reactor. This leads to a higher acidity of the wood chips and more rapid reaction.

In embodiments, the method further comprises determining a minimum flow of steam needed to heat the biomass material in the pressurized vessel to a predetermined temperature, wherein said adding steam comprises adding steam, for instance at said lower portion, at a flow being higher than the minimum flow, for instance at least 1.5 times the minimum flow, or at least 1.66 times the minimum flow, or at least twice of said minimum flow, or at least 2.5 times the minimum flow. Since more steam than needed for heating of the biomass is added to the vessel, the vapor which is withdrawn from the top of the vessel and added to the discharge device contains a significant amount of steam. This means that the amount of discharge steam added to the discharge device to achieve steam explosion discharge can be reduced or omitted altogether. This embodiment is advantageously combined with the above-described embodiment, where at least 50-80% or all of the steam is added to the lower portion.

The minimum flow $\dot{m}_{steam,heating}$ of steam needed to heat the biomass material may be determined as follows:

$$\dot{m}_{steam,heating}(P) = \frac{(\dot{m}_{biomass} \cdot c_{p,biomass} + \dot{m}_{water} \cdot c_{p,water}) * (T_{out} - T_{in})}{dh_{steam}(P)}$$

where $\dot{m}_{biomass}$ is the mass flow of the (dry) biomass, $\dot{m}_{water}$ is the mass flow of the water content of the biomass, $c_{p,biomass}$ and $c_{p,water}$ are the specific heats of (dry) biomass and water, respectively. $T_{out}-T_{in}$ is the temperature difference between outlet and inlet of the vessel. $dh_{steam}(P)$ is the specific enthalpy of the steam (depending on reactor vessel pressure P).

According to a second aspect of the invention a system for continuous hydrothermal steam treatment of biomass material is provided. The system comprises a substantially vertically arranged pressurized vessel, a discharge device for discharging the biomass material from a bottom portion of the pressurized vessel, a conduit connecting a top portion of the pressurized vessel with said discharge device, said conduit being provided with a control valve for controlling a flow of vapor from said top portion to said discharge device, a pressure measurement device for measuring differential pressure between said top portion of the pressurized vessel and said discharge device, and a control unit configured to control said control valve in response to differential pressure measurement data from said pressure measurement device. The control valve may be an electrically controllable valve. The pressure measurement device may be formed by two pressure sensors, one arranged at the top portion of the vessel, and one in the discharge device. Alternatively, the pressure measurement device may be a differential pressure sensor being in fluid communication with the top portion and the discharge device.

In embodiments, the system further comprises at least one steam injection device arranged to directly or indirectly provide discharge steam to the discharge device, wherein the control unit is configured to control the control valve and said steam injection device in response to differential pressure measurement data from said pressure measurement device. The steam injection device may be arranged to inject discharge steam directly into the discharge device, for example by being arranged in a through hole in a wall portion thereof. Alternatively, the steam injection device may be arranged to inject discharge steam indirectly via the conduit, i.e. be connected to the conduit to inject steam therein.

In embodiments of the system, the discharge device comprises a pressure sealing screw arranged at the bottom portion of the pressurized vessel and a steam explosion device, wherein the conduit is connected to the steam explosion device. The steam explosion device may comprise a discharge chamber connected to the pressure sealing screw to receive discharged biomass, and a blow valve arranged for steam explosion discharge of the biomass from the discharge chamber, wherein the conduit is connected to said discharge chamber. The steam explosion device may comprise a transport screw arranged to convey the biomass towards the blow valve. The transport screw may be arranged in the discharge chamber.

In embodiments, the system further comprises at least one steam injection nozzle arranged to provide steam into the pressurized vessel, each injection nozzle being provided with a corresponding valve to control the steam flow. One or more of the at least one steam injection nozzle may be arranged at a lower portion of the pressurized vessel. In embodiments, all of the steam injection nozzle(s) is/are arranged at a lower portion of the pressurized vessel.

In embodiments, the at least one steam injection nozzle is arranged and/or the control unit is configured to control the corresponding valve(s) such that at least 50%, or at least 60%, or at least 70%, or at least 80% of overall added steam is added at the lower portion of the pressurized vessel. For example, steam injection nozzles may be arranged at a lower portion and at one or more additional positions, such as at or near the top or upper portion, and/or in a mixing device arranged upstream of the pressurized vessel, and/or at the discharge device, where the control unit controls the corresponding valves such that the flow of added steam to the lower portion constitutes at least 50/60/70/80% of the overall flow of steam added at the lower portion and at the one or more additional positions.

In embodiments of the system, the control unit is further configured to determine a minimum flow of steam needed to heat the biomass material in the pressurized vessel to a predetermined temperature, and to control at least one, or each, valve of the at least one steam injection nozzle such that the total flow of steam into the pressurized vessel is higher than the minimum flow, such as at least 1.5 times the minimum flow, or at least 1.66 times the minimum flow, or at least twice of said minimum flow, or at least 2.5 times the minimum flow. The control unit may be configured to determine the minimum flow as explained above with reference to embodiments of the method according to the first aspect of the invention.

According to a third aspect of the invention, a method for continuously treating biomass material is provided. The method comprises feeding the biomass material into a substantially vertically arranged pressurized vessel, adding steam to said pressurized vessel for hydrothermal treatment of the biomass material, discharging the biomass material from a bottom or lower portion of the pressurized vessel by means of a discharge device, withdrawing vapor from a top or upper portion of the pressurized vessel, and adding said vapor to the discharge device. The method further comprises determining a minimum flow of steam needed to heat the biomass material in the pressurized vessel to a predetermined temperature, wherein said adding steam comprises adding steam at a flow being higher than the minimum flow.

In embodiments of the third aspect of the invention, the flow is at least 1.5 times the minimum flow, or at least 1.66 times the minimum flow, or at least twice of said minimum flow, or at least 2.5 times the minimum flow. In embodiments, the step of adding steam comprises adding at least 50%, or at least 60%, or at least 70%, or at least 80% of the overall steam flow at the lower portion. For example, the step of adding steam may comprise adding steam at a lower portion and at one or more additional positions, such as at or near the top or upper portion, and/or in a mixing device arranged upstream of the pressurized vessel, and/or in the discharge device, where the flow of added steam to the lower portion constitutes at least 50/60/70/80% of the overall flow of steam added at the lower portion and at the one or more additional positions. In embodiments, the step of adding steam (to the vessel) comprises adding steam solely at the lower portion. It is noted that this does not exclude that steam is added to the discharge device.

In embodiments of the third aspect of the invention, the method comprises controlling differential pressure between the top or upper portion of the pressurized vessel and the discharge device by controlling the flow of said vapor.

In embodiments of the third aspect of the invention, the method comprises controlling differential pressure between the top or upper portion of the pressurized vessel and the discharge device by controlling the flow of said steam.

The features of the embodiments described above are combinable in any practically realizable way to form embodiments having combinations of these features. Further, all features and advantages of embodiments described above with reference to the first aspect of the invention may be applied in corresponding embodiments of the second and third aspect of the invention.

BRIEF DESCRIPTION OF THE DRAWINGS

Above discussed and other aspects of the present invention will now be described in more detail using the appended drawings, which show presently preferred embodiments of the invention, wherein.

DETAILED DESCRIPTION

Figure 1:
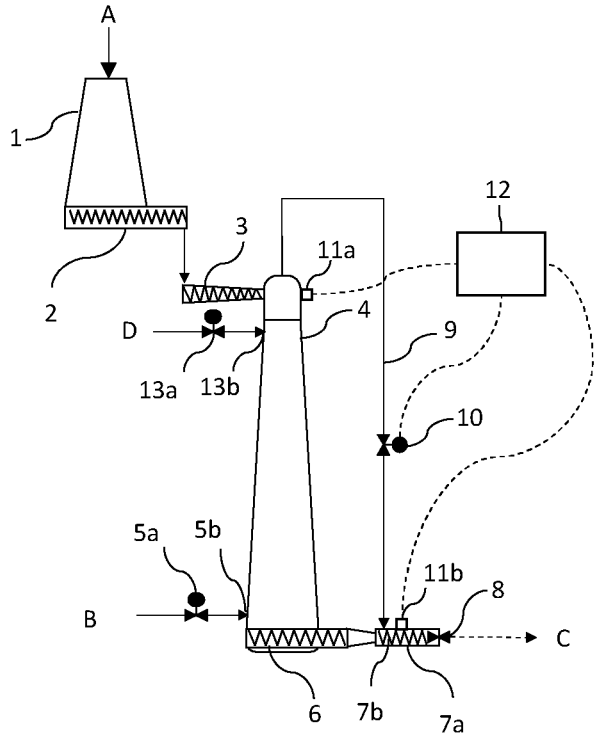
FIG. 1 shows a schematic illustration of an embodiment of the system according to the second aspect of the invention.

FIG. 1 shows a schematic illustration of an embodiment of the system according to the second aspect of the invention.

Biomass A is fed to the container 1, from which the biomass is continuously conveyed with a screw feeder 2, to a conical screw 3 for feeding of it into a pressurized vessel 4, e.g. a reactor. The conical screw compresses the biomass to a gas-tight plug which seals the pressure of the vessel 4 to atmospheric. A conical screw is a preferred but not a mandatory solution of feeding material to the vessel 4. It may optionally be replaced with other technical solutions such as a rotary lock feeder or a lock hopper system. The vessel 4 is substantially vertically arranged. Biomass from the screw 3 falls by gravity inside the vessel 4 and piles up inside the vessel. The biomass pile slowly moves downwards as it is continuously emptied in the bottom of the vessel 4 with a discharge screw 6 as a treated biomass C.

Steam B is added to a lower portion of the vessel 4 by means of steam injection nozzle 5*b*. The steam flow is controlled by valve 5*a*. The steam heats the biomass inside the vessel 4.

Steam D is also added to an upper portion of the vessel 4 by means of at least one additional steam injection nozzle 13*b* and valve 13*a*. At least 50% of the steam is added using the lower steam injection nozzle. The total flow of steam B, D provided by nozzles 5*b*, 13*b* is controlled to be at least 1.5 times the minimum flow of steam needed to heat the biomass material in the pressurized vessel to a predetermined temperature. Optionally, the valves 5*a*, 13*a* are electrically controlled by control unit 12 to achieve the desired flows.

A discharge device is formed by discharge screw 6 arranged at the bottom portion of the vessel and a thereto connected steam explosion device 7*a-b*, 8. The discharge screw continuously empties the bottom of the reactor. The discharge screw is of the pressure-sealing type, i.e. is gas-tight just like the feeding screw 3 which means that no steam passes concurrently with biomass to the discharge chamber 7*a* of the steam explosion device, which further comprises a blow valve/discharge nozzle 8 in the chamber 7. The steam explosion device further comprises a transport screw 7*b* arranged in the discharge chamber to convey the biomass towards the blow valve/discharge nozzle 8.

Accumulated VOC/NCG and excess steam in the gas phase of vessel 4 are led from the top portion of the vessel to the discharge chamber 7*a* via a conduit 9 connecting a top portion of the pressurized vessel with the discharge device, said conduit being provided with an electrically controllable valve 10 for controlling the flow of vapor in the conduit. A pressure measurement device is provided, which device comprises two pressure sensors 11*a*, 11*b*, one arranged at the top portion of the vessel, and one in the discharge device. The valve 10 and pressure sensors 11*a*, 11*b* are electrically connected to a control unit 12 configured to control valve 10 in response to differential pressure measurement data from the pressure sensors.

Typical operating conditions are as follows:

Temperature in reactor: 140-225° C.

Pressure: corresponding pressure 2-30 bar (g)

Residence time: 1 min-3 hours, preferably 3-20 minutes

Delta pressure at discharge: 2-30 bar, preferably 2-15 bar or 2-10 bar.

Figure 2:
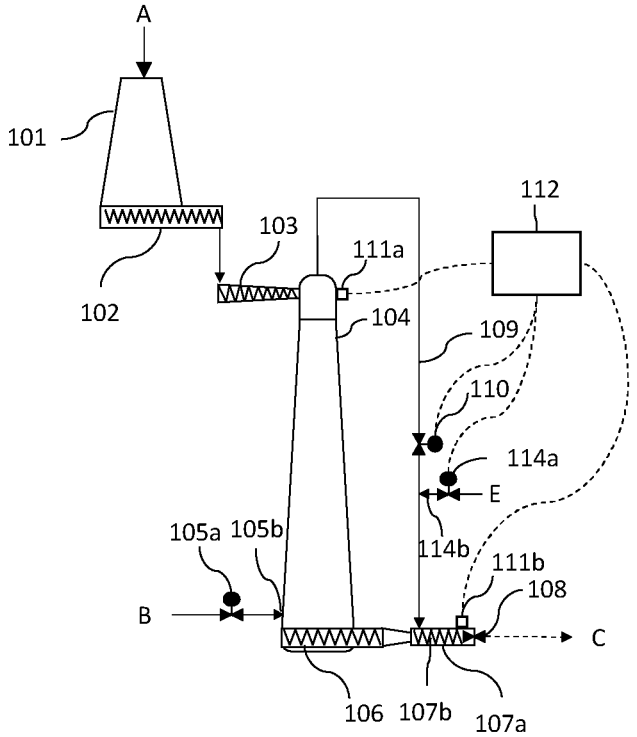
FIG. 2 shows a schematic illustration of another embodiment of the system according to the second aspect of the invention.

FIG. 2 shows a schematic illustration of an embodiment of the system according to the second aspect of the invention. Container 101, screw feeder 102, conical screw 103, pressurized vessel 104, valve 105*a*, steam injection nozzle 105*b*, discharge screw 106, steam explosion device 107*a-b*, discharge nozzle 108, conduit 109, electrically controllable valve 110, pressure sensors 111*a*, 111*b* and control unit 112 correspond to the refs. 1-12 in FIG. 1.

The embodiment in FIG. 2 differs in that steam is solely injected into the vessel 104 at a lower portion of the vessel using nozzle 105*b*. A further difference is that a steam injection device 114*b* is provided which is connected to conduit 109 to provide (fresh non-recirculated) discharge steam E to the discharge chamber 107*a* via the conduit. The control unit 112 is configured to control not only the electrically controllable valves 110 (as in FIG. 1) but also electrically controllable 114*a* in response to differential pressure measurement data from said pressure measurement device.

The flow of steam provided by nozzle 105*b* is controlled to be about 2 times the minimum flow of steam needed to heat the biomass material in the pressurized vessel to a predetermined temperature. For example, assuming that a total of 7 ton of fresh steam per hour is to be added to the system, and that 3 ton/hour is required for heating of the biomass, then about 6 ton/hour is added via nozzle 105*b* at the bottom of the vessel, and 1 ton/hour is added to the discharge chamber 107*a* using nozzle 114*a* via conduit 109.

Figure 3:
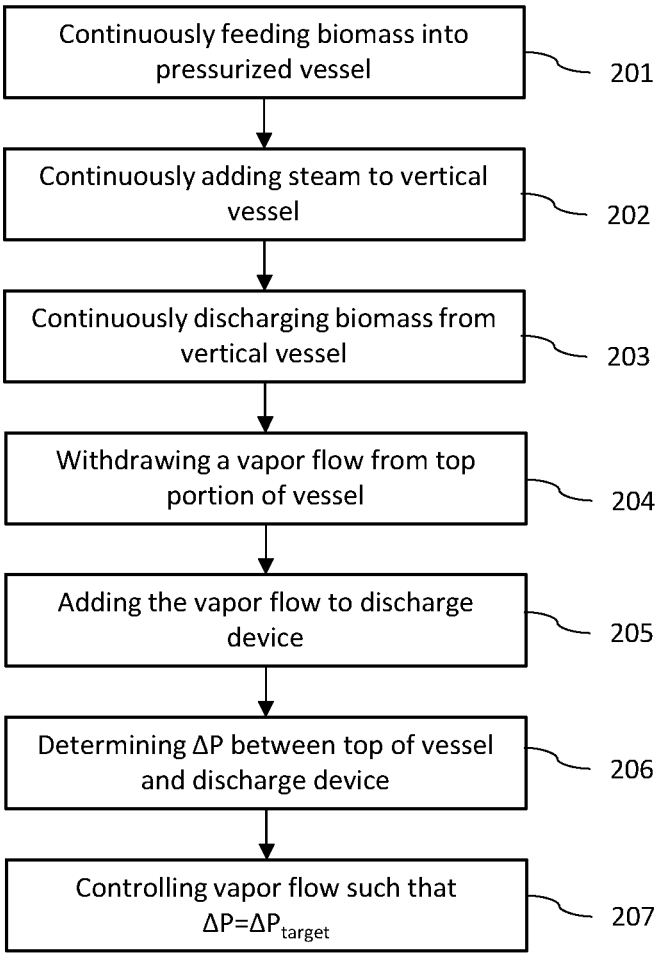
FIG. 3 shows a flow chart of an embodiment of the method according to the first aspect of the invention.

FIG. 3 shows a flow chart of an embodiment of the method according to the first aspect of the invention.

The method comprises continuously feeding 201 the biomass material into a substantially vertically arranged pressurized vessel, continuously adding 202 steam to the pressurized vessel for hydrothermal treatment of the biomass material, continuously discharging 203 the biomass material from a bottom or lower portion of the pressurized vessel by means of a discharge device, continuously withdrawing 204 vapor from a top or upper portion of the pressurized vessel, and adding the vapor 205 to the discharge device, determining differential pressure 206 between the top or upper portion of the pressurized vessel and the discharge device, and controlling the vapor flow 207 such that the differential pressure approaches a target value. For instance, if the differential pressure is larger than its target value, the vapor flow is increased and vice versa.

The description above and the appended drawings are to be considered as non-limiting examples of the invention. The person skilled in the art realizes that several changes and modifications may be made within the scope of the invention. For example, steam may be injected at further positions in the vessel, for instance at a vertically intermediate position or using a mixer upstream of the vessel. Further, the steam explosion device may be configured differently, for example without a transport screw. Further, the vessel may be provided with a vent at its top portion for venting off accumulated VOC/NCG and steam which is not presently possible to add to the discharge device. The scope of protection is determined by the appended patent claims.

The invention claimed is:

1. A method for continuously treating biomass material comprising:

feeding the biomass material into a substantially vertically arranged pressurized vessel;

adding steam to said pressurized vessel for hydrothermal treatment of the biomass material, wherein said adding steam comprises adding steam at a lower portion of the pressurized vessel;

discharging the biomass material from a bottom portion of the pressurized vessel using a discharge device;

withdrawing vapor from a top portion of the pressurized vessel, and adding said vapor to the discharge device;

controlling differential pressure between said top portion of the pressurized vessel and said discharge device by controlling a flow of said vapor; and determining a minimum flow of steam needed to heat the biomass material in the pressurized vessel to a predetermined temperature, wherein said adding steam comprises adding steam at a flow that is higher than said minimum flow.

2. The method according to claim 1, further comprising adding discharge steam from a source of steam to the discharge device, wherein said differential pressure is controlled by controlling the flow of said discharge steam.

3. The method according to claim 2, wherein:

said controlling comprises controlling the flow using a valve arranged in a conduit connecting said top portion of the pressurized vessel and said discharge device; and said discharge steam is added to said discharge device indirectly by being added to said conduit.

4. The method according to claim 1, wherein said discharge device comprises a pressure sealing screw arranged at said bottom portion of the pressurized vessel, and a steam explosion device, wherein said vapor is added to said steam explosion device.

5. The method according to claim 4, wherein said steam explosion device comprises a discharge chamber connected to the pressure sealing screw to receive discharged biomass, and a blow valve arranged for steam explosion discharge of the biomass from said discharge chamber, wherein said vapor is added to said discharge chamber.

6. The method according to claim 1, wherein said adding steam further comprises adding steam at or near said top portion of the pressurized vessel.

7. The method according to claim 1, wherein said adding steam further comprises adding steam together with the biomass material upstream of the vertical pressurized vessel.

8. The method according to claim 1, wherein said adding steam comprises adding at least 50% of overall added steam at said lower portion.

9. The method according to claim 1, wherein said adding steam comprises adding steam at a flow being at least 50% higher than said minimum flow.

10. The method according to claim 1, wherein said controlling comprises controlling the flow using a valve arranged in a conduit connecting said top portion of the pressurized vessel and said discharge device.

11. The method according to claim 1, wherein said vapor comprises steam and/or VOC and/or inert gases.

12. A system for continuous hydrothermal steam treatment of biomass material, said system comprising:

a substantially vertically arranged pressurized vessel;

a discharge device configured to discharge the biomass material from a bottom portion of the pressurized vessel;

a conduit connecting a top portion of the pressurized vessel with said discharge device, said conduit comprising a control valve for controlling a flow of vapor from said top portion to said discharge device;

a pressure measurement device configured to measure differential pressure between said top portion of the pressurized vessel and said discharge device, at least one steam injection nozzle configured to inject steam into said pressurized vessel, each injection nozzle comprising a corresponding valve to control the steam flow, wherein at least one of said at least one steam injection nozzle is arranged at a lower portion of said pressurized vessel, and a control unit configured to control said control valve in response to differential pressure measurement data from said pressure measurement device, the control unit further being configured to determine a minimum flow of steam needed to heat the biomass material in the pressurized vessel to a predetermined temperature, and to control each valve of the at least one steam injection nozzle such that the total flow of steam into the pressurized vessel is higher than said minimum flow.

13. The system according to claim 12, further comprising at least one steam injection device configured to directly or indirectly provide discharge steam to the discharge device, wherein said control unit is configured to control said control valve and said steam injection device in response to differential pressure measurement data from said pressure measurement device.

14. The system according to claim 12, wherein said discharge device comprises a pressure sealing screw arranged at said bottom portion of the pressurized vessel, and a steam explosion device, wherein said conduit is connected to said steam explosion device.

15. The system according to claim 14, wherein said the steam explosion device comprises a discharge chamber connected to the pressure sealing screw to receive discharged biomass, and a blow valve arranged for steam explosion discharge of the biomass from said discharge chamber, wherein said conduit is connected to said discharge chamber.

* * * * *